US005710532A

United States Patent [19]

Morgan et al.

[11] Patent Number: 5,710,532

[45] Date of Patent: Jan. 20, 1998

[54] SOLENOID WITH MOVEMENT DAMPENER

[75] Inventors: Rick Morgan, Arlington Heights; Robert S. Morrison, Elgin, both of Ill.

[73] Assignee: Capcom Coin-Op, Inc., Arlington Heights, Ill.

[21] Appl. No.: 440,534

[22] Filed: May 12, 1995

[51] Int. Cl.[6] ..... H01F 7/18

[52] U.S. Cl. ..... 335/239; 335/242

[58] Field of Search ..... 335/238, 239, 335/240, 241, 253, 254, 215, 242

[56] References Cited

U.S. PATENT DOCUMENTS

| | | | |
|---|---|---|---|
| 1,896,904 | 2/1933 | Laven | 335/239 |
| 4,896,127 | 1/1990 | Hida | 335/239 |
| 5,507,488 | 4/1996 | Eddy et al. | 273/119 R |

*Primary Examiner*—Lincoln Donovan

*Attorney, Agent, or Firm*—Gary Jarosik

[57] ABSTRACT

A solenoid having a controlled rate of motion is provided. The solenoid includes a housing having a channel disposed therein, a coil disposed around the channel for providing an electromagnetic force in response to a current being supplied therethrough, and a plunger disposed within the channel and movable between a first position and a second position in response to the presence or absence of the electromagnetic force. A dampener is linked to the plunger which creates an atmospheric pressure differential as the plunger moves to one or both of the first position or the second position which pressure differential acts to slow the rate of movement of the plunger.

2 Claims, 2 Drawing Sheets

SOLENOID WITH MOVEMENT DAMPENER

BACKGROUND OF THE INVENTION

This invention relates generally to solenoids and, more particularly, relates to a solenoid having a dampening means used in conjunction with pinball play features whereby the rate of movement of the solenoid and the corresponding movement of the pinball play features may be controlled.

It is known in the art to use solenoids to control movement of play features disposed on a pinball machine or amusement game playfield. The solenoids currently employed comprise a housing having a channel disposed therein with a plunger movably disposed within the channel. Surrounding the channel is a winding such that when current is supplied to the winding an electromagnetic field is produced which causes the plunger to move within the channel. Typically, the play feature to be controlled by the solenoid is linked to the plunger such that any movement of the plunger produces a corresponding movement of the play feature. With the currently employed solenoids, it is seen that the movement of the plunger in response to the electromagnetic field generated by the windings is very fast. This quick movement of the plunger causes a corresponding quick, jerking movement of the play feature. As such, an unfilled need exists in the art to provide a means for controlling the rate of movement of the play feature such that the play feature will appear to the player of the pinball game to move more smoothly. In addition, a need exists to control the movement of play feature whereby the play feature will be protected from breaking during said movement. Furthermore, a need has arisen to provide a play feature for an amusement game in which a time delay is provided between movement of the play feature between two extreme positions.

As a result of these existing needs, it is an object of the present invention to provide a solenoid having a dampening means whereby movement of the plunger within the solenoid in response to the electromagnetic field is slowed.

SUMMARY OF THE INVENTION

In accordance with the present invention a solenoid having a controlled rate of motion is provided. In one embodiment, the solenoid includes a housing having a channel disposed therein, a coil disposed around the channel for providing an electromagnetic force in response to a current being supplied therethrough, a plunger disposed within the channel and movable between a first position and a second position in response to the presence or absence of the electromagnetic force, and a seal positioned around the plunger and cooperative with the channel for creating an atmospheric pressure differential within the channel as the plunger moves to one or both of the first position and the second position which pressure differential acts to slow the rate of movement of the plunger.

In an alternative embodiment, the solenoid includes a solenoid housing having a channel disposed therein, a coil disposed around the channel for providing an electromagnetic force in response to a current being supplied therethrough, a solenoid plunger disposed within the channel and movable between a first position and a second position in response to the presence or absence of the electromagnetic force, a dampener housing in which is movably disposed a dampener plunger, the dampener plunger having a seal positioned therearound and cooperative with the dampener housing, and a link connecting the solenoid plunger to the dampener plunger whereby movement of the solenoid plunger produces a reciprocal movement of the dampener plunger wherein the movement of the dampener plunger in response to the movement of the solenoid plunger to one or both of the first position and the second position creates an atmospheric pressure differential within the dampener housing which pressure differential acts to slow the rate of movement of the solenoid plunger.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiments shown in the following drawings in which.

DETAILED DESCRIPTION

While the invention can be used in conjunction with any application wherein the rate of movement of the plunger in a solenoid is desired to be controlled, it will be described hereinafter in the context of a solenoid for use in moving a play feature on a pinball playfield as the preferred embodiment thereof.

Figure 1:
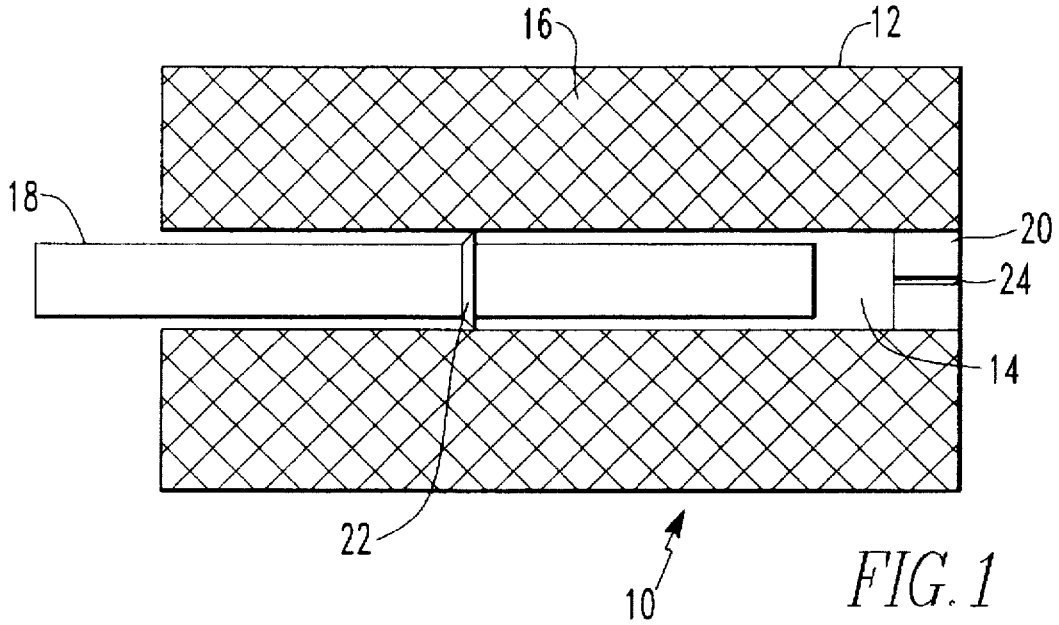
FIG. 1 illustrates a cross-sectional view of the solenoid in a first embodiment of the present invention.

Referring now to the figures, wherein like reference numerals refer to like elements, there is shown in FIG. 1 a solenoid 10. The solenoid 10 generally includes a housing 12 having a channel 14 disposed therein. Surrounding the channel 14 is at least one electrical winding or coil 16 to which current is supplied to generate an electromagnetic force within the channel 14. Movably disposed within the channel 14 is a plunger 18. As is known in the art, the plunger 18 is movable within the channel 14 in response to the electromagnetic force generated by the coil 16 in response to current flow therethrough. In the embodiment illustrated in FIG. 1, the channel 14 is further provided with a seat 20, which may be either an integral part of the housing 12 or a plug inserted within the channel 14, which functions to limit the inward movement of the plunger 18. A spring (not illustrated) may be used to bias the plunger 18 and is typically trapped between the bell plunger and the solenoid housing.

To control the movement of the plunger 18 within the channel 14 of the solenoid 10, in response to the electromagnetic force generated by coils 16, a gasket like seal 22 is provided around the plunger 18. In one embodiment, the seal 22 is preferably a one-way seal constructed from a rubber, a flexible polymer, or the like and generally has the shape of a cup, disk, or o-ring. The seal 22 is attached to the plunger 18 by inserting the seal 22 within a groove formed in the plunger 18 or by otherwise adhering the seal 22 thereto.

In operation, when the plunger 18 is caused to be drawn inward by the electromagnetic force generated by coil 16, the one-way seal 22 expands to seal the gap between the plunger 18 and the inside walls of the channel 14. Thereafter, as the plunger 18 continues to move inwardly within the channel 14, air pressure is built within the channel 14 between the seat portion 20 and the seal 22. This air pressure serves to slow the inward movement of the plunger 18 as the air pressure provides a force upon the plunger 18 which force counters the electromagnetic force generated by the coil 16. A vent 24 is further preferably provided within the seat 20 for allowing the controlled release of the air under pressure in the channel 14 in order that the plunger 18 will not be completely stopped by the air pressure built between the seal 22 and the seat 20. As is apparent to one skilled in the art, controlling the diameter of the vent 24 similarly controls the pressure within the channel 14 such that regulating the diameter of the vent 24 will likewise regulate the rate in which the plunger 18 moves within the channel 14.

When the seal 22 is a one-way seal, during the outward movement of the plunger 18 (such as under the bias of a spring and when the current to the coil 16 is removed), the seal 22 collapses such that there exists no seal between the plunger 18 and the inside walls of the channel 14. As a result of this lack of a seal during the outward movement of the plunger 18, the solenoid 10 will operate similarly to those solenoids currently employed in the art in that the plunger 18 will move quickly to its extended position upon deactivation of the solenoid coil 16.

It is also contemplated that the seal 22 could be a two-way seal. During operation, the two-way seal 22 functions exactly as described previously with respect to the one-way seal during the inward movement of the plunger 18 in response to the electromagnetic force generated by the coil 16. However, the two-way seal 22 also functions to control the movement of the plunger 18 when the plunger 18 is caused to be moved to its extended position as the two-way seal will not collapse under this motion. Specifically, the outward movement of the plunger 18 causes a vacuum in the channel 14 between the seal 22 and the seat portion 20 which vacuum places a suction force upon the plunger 18 which force counters the force applied thereto by the bias means. Again, the vent 24 allows air to enter the channel 14 to relieve the vacuum created therein so as to allow the plunger 18 to move outwardly. As will be understood by those skilled in the art, the diameter of the vent 24 controls the flow of air into the channel 14 which in turn controls the rate at which the vacuum therein is relieved. As such, regulating the size of the vent 24 will correspondingly regulate the rate of movement of the plunger 18 in the outward direction.

It is to be understood that a one-way seal placed in a configuration opposite of that previously described will function to create a vacuum and slow the plunger 18 during its outward stroke in the same manner described with respect to the two-way seal but will not function to inhibit the motion of the plunger 18 during its inward stroke.

Figure 2:
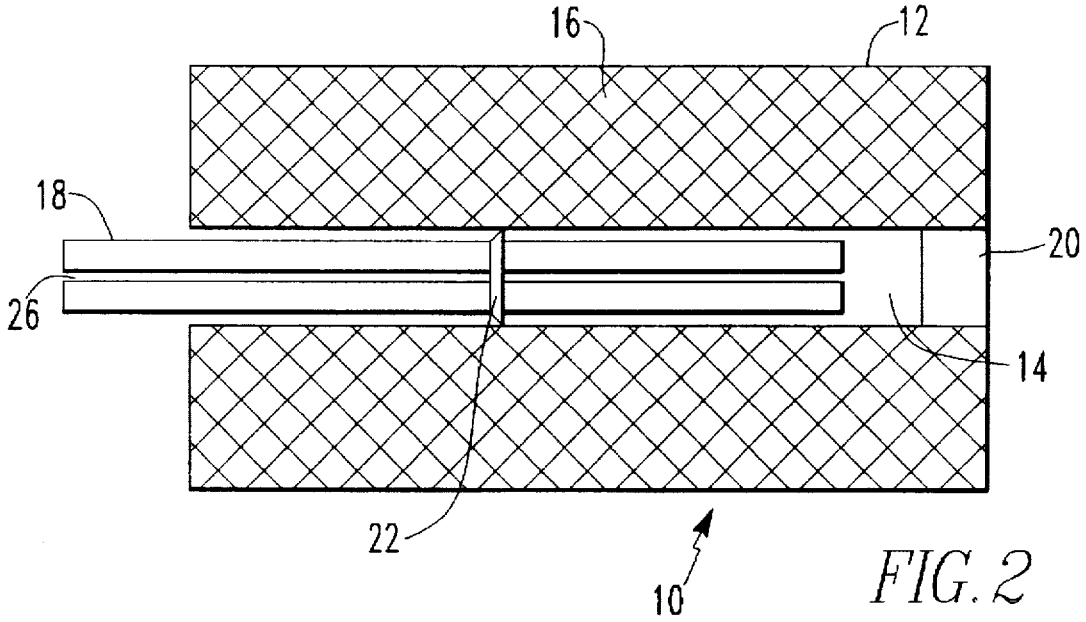
FIG. 2 illustrates a cross-sectional view of the solenoid in a second embodiment of the present invention.

In FIG. 2 an alternative embodiment of the present invention is illustrated. In this embodiment, the plunger 18 is provided with a vent opening 26 which leads to the channel 14 between the seal 22 and the seat portion 20 for the purpose of relieving the air pressure and/or vacuum created therebetween by the movement of the plunger 18. The operation of this embodiment is the same as that previously described with respect to the embodiment having the vent 24 in the seat portion 20 for both the one-way and two-way seals 22 and, therefore, will not be discussed in further detail in relation to this illustrative embodiment. In a further embodiment, a sleeve, which is typically provided between the plunger and the solenoid windings, may be formed with one or more passages through which the air could pass. Preferrably, such a sleeve would be injection molded for reducing the manufacturing cost thereof.

Figure 3:
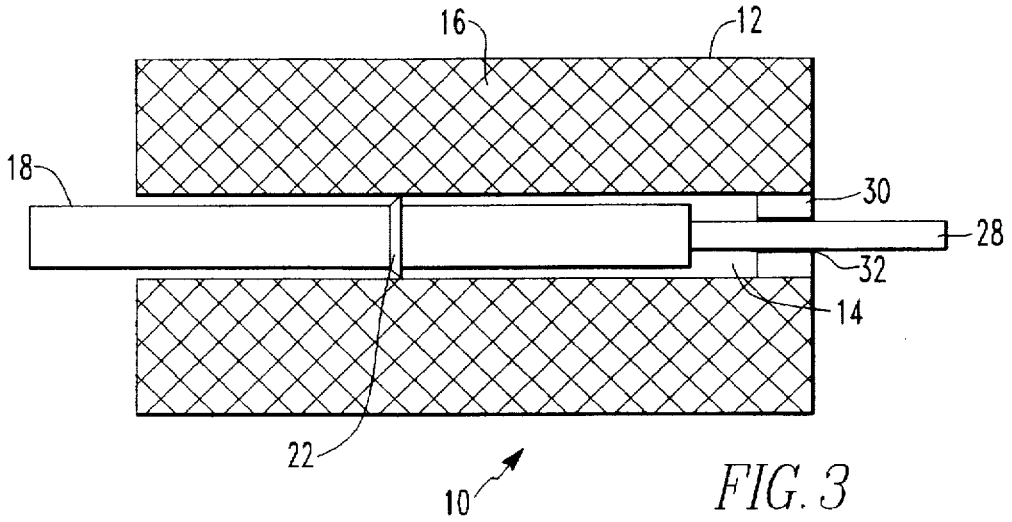
FIG. 3 illustrates a cross-sectional view of the solenoid in a third embodiment of the present invention.

In FIG. 3, a further embodiment of the present invention is illustrated wherein the plunger 18 has a projection 28 extending therefrom. The projection 28 preferably extends from the housing 12 when the plunger 18 is in the retracted position for purposes which will be familiar to those skilled in the art. As described previously, the seal 22 may be either the one-way or the two-way type. To assist the seal 22 in creating the pressure and/or vacuum within the channel 14, the housing 12 is preferably provided with a gasket 30, or the like, through which extends the projection 28. A vent 32 may be created by leaving a gap between the gasket 30 and the plunger 28. In the alternative, provided the gasket 30 is mated into engagement with the plunger 28, the plunger 18 may be provided with a vent as described with respect to the previously illustrated embodiment. The operation of this embodiment, for both the one-way and the two-way seal 22, is as described previously excepting that the seal 22 now cooperates with the gasket 30 to create the pressure and/or vacuum used to control the movement of the plunger 18.

Figure 4:
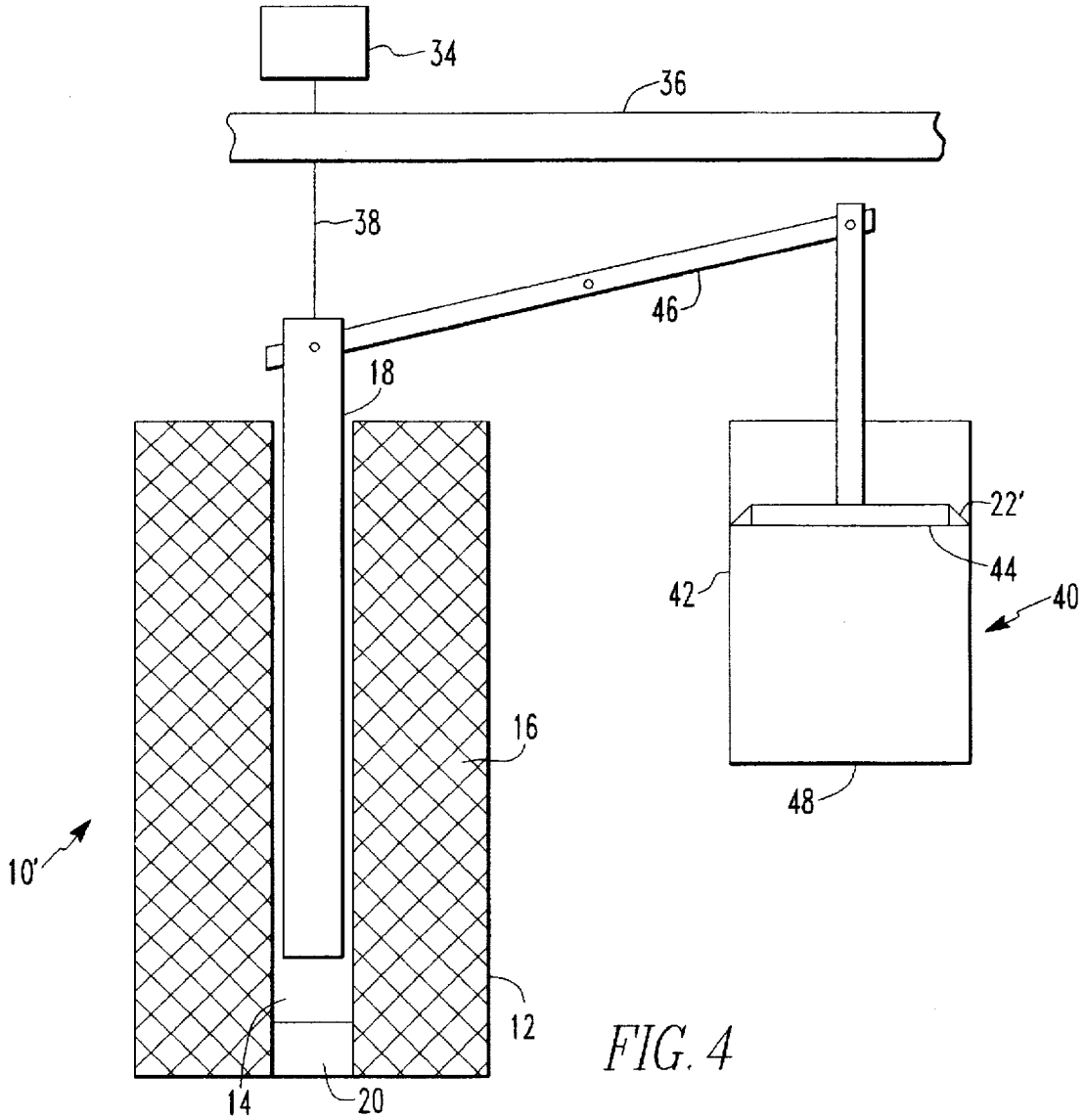
FIG 4 illustrates a cross-sectional view of the solenoid in a fourth embodiment of the present invention.

Turning to FIG. 4, yet another embodiment of the present invention is illustrated. In this embodiment, a conventionally available solenoid 10' is used to reciprocate a pinball play feature 34 disposed on the playfield 36. The play feature 34 is linked to the plunger 18 of the solenoid 10' by a link 38 in a manner well known to those skilled in the art. To control the rate of movement of the plunger 18 within the channel 14 of the solenoid 10' an external dampener 40 is provided. The external dampener 40 generally includes a housing 42 in which is disposed a movable plunger assembly 44. The plunger assembly 44 has disposed therearound a seal 22'. The plunger assembly 44 is pivotally connected to one end of a rotating link 46 which is turn pivotally connected at its other end to the plunger 18. The solenoid 10' and the dampener 40 are preferably supported by a bracket (not illustrated) which is attached to the playfield 36 in a conventional manner.

In operation, the plunger 18 of the solenoid 10' moves conventionally in response to the electromagnetic force applied thereto by the coil 16. However, movement of the plunger 18, besides causing movement of the play feature 34, causes the link 46 to reciprocate or rotate which in turn moves the plunger assembly 44 correspondingly in or out of the housing 42 of dampener 40. As described previously, the seal 22' may be chosen to create a pocket of pressure within the housing 42, between the seal 22' and the bottom of the housing 42, when the plunger assembly 44 is caused to be downwardly driven whereby the pressure created within the housing 42 will counter the upward movement of the plunger 18 in the solenoid 10' causing the same to slow its movement to the extended position. A vent 48 is preferably provided in the housing 42 to control the pressure build up therein and to correspondingly control the degree of dampening provided. Similarly, the seal 22' may be chosen to create a vacuum within the housing 42, between the seal 22' and the bottom of the housing 42, such that the downward motion of the solenoid plunger 18 is slowed by the corresponding upward motion of the plunger assembly 44 operating against the force of the vacuum created therein. Again, a vent 48 is preferably provided to assist in relieving the vacuum created within the housing 42. It is to be noted that, while the dampener 40 and the solenoid 10' are illustrated as being linked by the rotational arm 46, various other arrangements between the two devices are contemplated provided the proper interaction between the two is achieved.

It also is to be noted that it is contemplated that a means may be provided to adjust the diameters of any openings through which the trapped air may pass to further modify or vary the rate at which the plunger moves within the solenoid.

It should be apparent from the preceding description that this invention has among other advantages, the advantage of providing a means to control the movement of a play feature by providing a means for controlling the rate of movement of a plunger within a solenoid to which the play feature is attached.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. A solenoid having a controlled rate of motion, comprising:

a solenoid housing having a channel disposed therein;

a coil disposed around said channel for providing an electromagnetic force in response to a current being supplied therethrough;

a solenoid plunger disposed within said channel and movable between a first position and a second position in response to the presence or absence of said electromagnetic force;

a dampener housing in which is movably disposed a dampener plunger, said dampener plunger having a seal positioned therearound and cooperative with said dampener housing; and a link connecting said solenoid plunger to said dampener plunger whereby movement of said solenoid plunger produces a reciprocal movement of said dampener plunger;

wherein said movement of said dampener plunger in response to said movement of said solenoid plunger to one of said first position or said second position creates an atmospheric pressure differential within said dampener housing which pressure differential acts to slow the rate of movement of said solenoid plunger.

2. A pinball machine, comprising:

a playfield upon which is disposed a movable play feature;

a housing having a channel disposed therein;

a coil disposed around said channel for providing an electromagnetic force in response to a current being supplied therethrough;

a solenoid plunger disposed within said channel and movable between a first position and a second position in response to the presence of said electromagnetic force;

a dampener housing in which is movably disposed a dampener plunger having a seal positioned therearound and cooperative with said dampener housing for use in creating an atmospheric pressure differential within said dampener housing to slow the rate of movement of said dampener plunger in at least one direction; and a linkage connecting said solenoid plunger to said dampener plunger and said movable play feature.

* * * * *